United States Patent [19]

Hořáček et al.

[11] 4,134,433

[45] Jan. 16, 1979

[54] APPARATUS FOR PRODUCING KNIT-WOVEN FABRIC SELVAGE STRUCTURE

[75] Inventors: Oldrich Hořáček, Liberec; František Šilar, Vratislavice n/Nisou; Dalibor Rychlík, Liberec, all of Czechoslovakia

[73] Assignee: Statni vyzkumny ustav textilni, Liberec, Czechoslovakia

[21] Appl. No.: 867,509

[22] Filed: Jan. 6, 1978

Related U.S. Application Data

[62] Division of Ser. No. 829,887, Sep. 1, 1977, Pat. No. 4,106,531.

[30] Foreign Application Priority Data

Sep. 9, 1976 [CS] Czechoslovakia ..... PV5785-76

[51] Int. Cl.[2] ..... D03D 23/00; D03D 25/00

[52] U.S. Cl. ..... 139/383 B; 66/125 R

[58] Field of Search ..... 66/190, 193, 192, 169, 66/170, 125, 84, 85; 139/383, 11, 431, 432

[56] References Cited

U.S. PATENT DOCUMENTS

| | | | |
|---|---|---|---|
| 3,556,165 | 1/1971 | Zmatlik et al. | 139/383 B |
| 3,728,876 | 4/1973 | Richard et al. | 66/192 |
| 3,880,202 | 4/1975 | Mohelnicky et al. | 139/383 B |
| 3,885,601 | 5/1975 | Zmatlik et al. | 139/383 |

*Primary Examiner*—Ronald Feldbaum

[57] ABSTRACT

There is disclosed an apparatus for producing a selvage structure of a knit-woven fabric. The knit-woven fabric is produced in a warp-knit structure from weft thread loops and comprises spaced apart stitch wales with warp thread groups disposed therebetween, the warp threads being interlaced with stitch connecting loops to form a weave. The selvage of such fabric consists of a weft thread and a marginal weft thread, and comprises a marginal wale built by mutually binding stitches from a weft thread, stitches from a marginal weft thread, and stitches from a lock thread.

The apparatus for producing the aforedescribed selvage structure comprises a knitting mechanism for building a warp-knit structure from loops of weft thread, unwound from a stationary supply, said knitting mechanism comprising, on the one hand, a system of lapping guides the lapping arms of which are reciprocatorily swingable in open shed from an intermediate start position to one of extreme lapping positions and back again, the lapping guides protruding permanently between warp threads of at least one of the two shed planes, and, on the other hand, a system of knitting needles with closable hooks, of which number corresponds to that of lapping guides, the knitting needle system being arranged across the fabric and mounted for reciprocation from a foremost start position in front of the beat-up plane of the fabric to an operating position in open shed and back again, in order to engage the weft threads being laid, at either side of the system of lapping guides an auxiliary lapping guide is arranged for laying the lock thread, into the marginal knitting needle, the operation of said auxiliary lapping guide being the same as that of the lapping guides.

3 Claims, 33 Drawing Figures

APPARATUS FOR PRODUCING KNIT-WOVEN FABRIC SELVAGE STRUCTURE

This is a division of application Ser. No. 829,887, filed Sept. 1, 1977, now U.S. Pat. No. 4,106,531.

The invention relates to an apparatus for forming the selvage on a knit-weaving loom comprising a knitting mechanism for building a warp-knit structure from loops of weft thread unwound from a stationary supply, means for beating up the stitch connecting loops into the fabric fell, said knitting mechanism comprising, on the one hand, a system of lapping guides the lapping arms of which are reciprocatorily swingable in open shed position from an intermediate start position to one of extreme lapping positions and back again, the lapping guides permanently protruding between warp threads of at least one of the two shed planes and, on the other hand, a system of knitting needles with closable hooks, the number of which corresponds to that of the lapping guides, the knitting needle system being arranged across the fabric and mounted for reciprocation from a foremost, starting position in front of the beat-up plane of the fabric to an operating position in open shed position and back again, in order to engage the weft threads being laid.

The characteristic feature of the knit-woven fabric, which can be manufactured on the knit-weaving machine disclosed in the Czechoslovak Inventor's Certificate No. 153,246, consists of a warp-knit structure built from weft thread loops and comprising stitch wales disposed between groups of warp threads binding with stitch connecting loops in a weave. It has been proved that, from the viewpoint of utility parameters, the knit-woven fabrics according to Czechoslovak Inventor's Certificates Nos. 162,119 and 162,120 are particularly advantageous.

Thus, for instance, the knit-woven fabrics disclosed in the Czechoslovak Inventor's Certificate No. 162,120 are manufactured in an open two-coarse atlas structure of which closed reverse stitches are built by end bights of hairpin-shaped weft loops. Pairs of the connecting loops of reverse stitches which are substantially parallel with one another bind, in a longitudinal strip between the wales of reverse stitches, with warp threads in a weave. Between the reverse stitches of the wale there are located tuck loops which actually represent a connecting bight or bridge between successive weft loops built from one and the same weft threads.

A disadvantage of the afore-mentioned fabrics consists in selvages built of weft thread loops alternating with marginal loops of marginal weft thread, the former overlapping the latter.

The weft thread loops are not interlaced to a wale but lie loose on the marginal loops. Such selvages are not firm, are not aesthetic, and do not meet the claims laid upon the fabric selvage with regard to further fabric processing in finishing plants. The warp threads of such fabrics, if subjected to stress in a transverse direction, become loose whereby the appearance of the final product deteriorates.

Another drawback thereof is that it is necessary to use, at least for the marginal warp thread, a plain weave in order that said warp thread may pass over the weft thread loop at the one side, and over the marginal weft loop at the other side.

For carrying out the method of producing knit-woven fabrics in accordance with the inventions an apparatus is provided on a knit-weaving machine for manufacturing knit-woven fabrics, said machine comprising a knitting mechanism for building a warp-knit structure from loops of weft thread unwound from a stationary supply, means for beating up stitch connecting loops into the fabric fell, said knitting mechanism comprising, on the one hand, a system of lapping guides the lapping arms of which are reciprocatorily swingable in an open shed position from an intermediate start position to one of extreme lapping positions and back again, the lapping guides protruding permanently between warp threads of at least one of the two shed planes, and, on the other hand, a system of knitting needles with closable hooks, the number of which corresponds to that of the lapping guides, the knitting needle system being arranged across the fabric and mounted for reciprocation from a foremost start position in front of the beat-up plane of the fabric to an operating position in open shed and back again, in order to engage the weft threads being laid.

In accordance with the invention, on each side of the system of lapping guides there is disposed an auxiliary lapping guide for laying the lock thread which is unwound from a supply package into the marginal knitting needle, the operation of said auxiliary lapping guide being the same as that of the lapping guides.

According to a second embodiment of the apparatus, with each of the auxiliary lapping guides there is associated a hook disposed at either side of the system of knitting needles and movable in synchronism with knitting needles for temporarily engaging the lock thread laid by the auxiliary lapping guide, and the marginal weft thread laid by the marginal lapping guide.

According to a third embodiment of the apparatus, the intermediate starting position of the marginal lapping guide is oriented relative to the intermediate starting position of the auxiliary lapping guide, in such a manner that the geometrical projections of the two guides onto a horizontal plane are concurrent.

The apparatus according to the invention is simple, reliable in operation and usable in existing knit-weaving machines without the necessity of substantial constructional adaptations of the knitting mechanism thereof.

The selvage structure of knit-woven fabric and the method for producing the same can be applied also to the knit-woven fabrics disclosed in German Publication (DT OS) No. 2,034,120. However, the machine for manufacturing the aforementioned fabrics requires a suitable adaptation for this purpose.

Some preferred embodiments of knit-woven fabric selvage structures and of apparatus for manufacturing the same will be hereinafter described with reference to the accompanying drawings in which FIG. 1*a* is a side view of the operating mechanism of a schematically shown knit-weaving machine;

FIG. 1*b* is a top view of the mechanism shown in FIG. 1*a*;

FIG. 2 is a fragmentary view of a knit-woven fabric with an unfirm selvage, forming the subject matter of the Czechoslovak Inventor's Certificate No. 162,120;

FIGS. 3–8, inclusive, are views showing six various different embodiments of selvage structures according to the invention;

FIGS. 9–11, inclusive, are schematic views of three different exemplary embodiments of apparatus for knit-woven fabric selvage structure; and FIGS. 12–32, inclusive, illustrate different processes of producing various knit-woven fabric selvage structures.

DESCRIPTION OF PREFERRED EMBODIMENTS

Figure 1A:
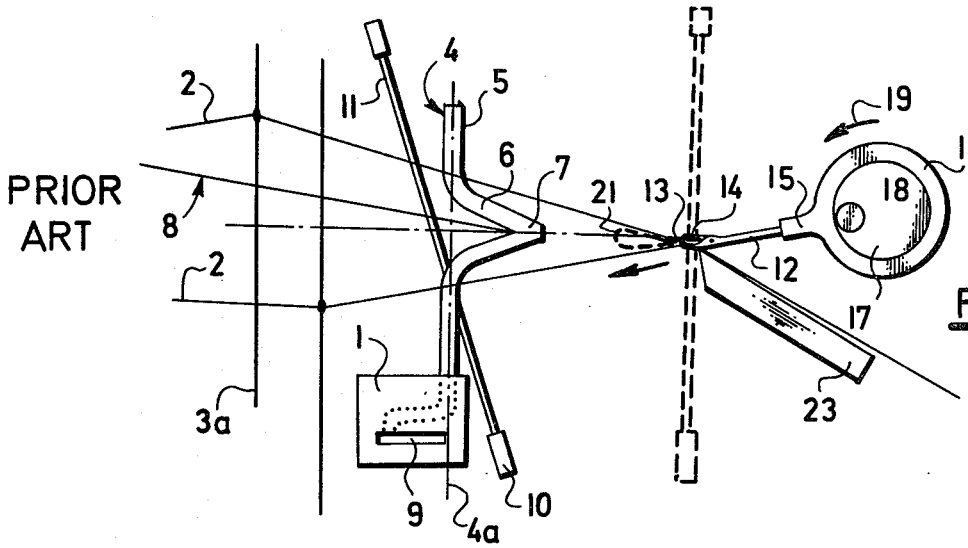
Figure 1B:
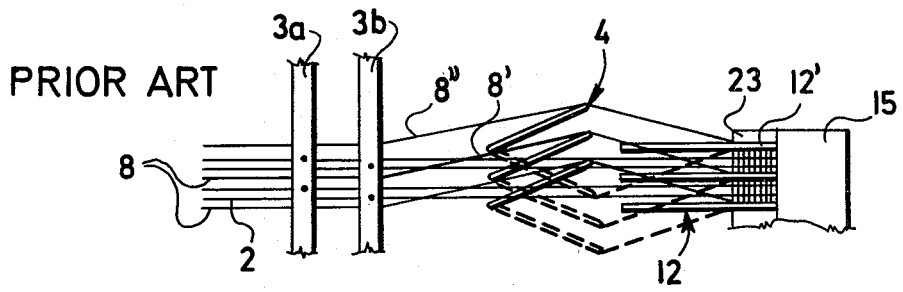

As hereinbefore set forth, FIGS. 1*a* and 1*b* schematically illustrate the known operating mechanism of a knit-weaving loom. A cross bed 1 disposed between side frames (not shown) of the loom under warp threads 2 and in front of heald frames 3*a*, 3*b* supports an array of lapping guides 4 arranged side-by-side thereon and mounted for swinging. Each lapping guide 4 has a stem 5 extending to its intermediate part into a tonque-shaped arm 6 terminating in a thread guiding eyelet 7 to be threaded-in with warp thread 2. Warp threads 2 as well as weft threads 8 are unwound from warp beams (not shown), or any other supply package disposed on a creel provided on the loom. The swinging movement of the lapping guides 4 is derived from a bar 9 supported in the bed 1 to reciprocate therein by means of a motion mechanism (not shown) of the knit-weaving loom.

Further the knit-weaving loom comprises a sley 10 provided with a reed 11, the swinging movement of the former being derived from a not shown mechanism. The dent spacings of the reed 11 are threaded-in with warp threads 2. Those spacings between the dents of the reed 11 designed as passages for the lapping guides 4 are wider than those designed for warp threads 2. In the shed exchange phase in which the sley 10 is in its rear or delay position, the lapping guides 4 simultaneously swing from their intermediate start position to one of two extreme positions and back again, while during the next shed exchange phase they swing again from said intermediate start position to the opposite extreme or thread-laying position and back again.

Opposite each lapping guide 4 there is situated a knitting needle 12 having a hook 13 to be closed, for example, by a latch 14, the longitudinal axis of the needle 12 being concurrent relative to the axis 4*a* of the swinging movement of the lapping guide 4.

The inoperative stem extremities of the knitting needles 12 are fixed in a bed 15 provided with a collar 16 encircling an eccentric cam 17 which is secured on a shift 18 driven in a one-to-one gear ratio from the main shaft of the loom. The cam 17 is rotatable in the direction of the arrow 19.

The knitting needles 12 are mounted for reciprocation from their foremost start position to their operating position in open shed and back again. During this movement, the needle hooks 13 describe — in the direction of arrow 20 — an endless drop-shaped path 21 arising from the fact that the needle stems bear upon an operating edge 22 of a support bar 23 designed for guiding a fabric 24 being produced. The fabric 24 is withdrawn over a breast beam (not shown) to a not shown take-up means. The knitting needles 12 are displaced from their foremost start position situated in front of the beat-up plane of the fabric 24, to their rear operating position while the lapping guides 4 are being simultaneously swung to one of their extreme positions. During the upward movement of the needle hooks 13, the lapping guides 4 lay weft threads 8 into the hooks 13. During the subsequent backward movement of knitting needles 12 to their start position there are built new stitches in the hooks 13 of the knitting needles 12 from laid-on loops of weft threads 8 by drawing said loops through the old stitches entrapped on the knitting needle stems in the previous work cycle.

The lapping guides 4 simultaneously return to their intermediate start positions whereupon the beat-up of the thus built pair of stitch connecting loops into the fabric fell follows. In the next work cycle, the knitting needles 12 and the lapping guides 4 operate again, except that the latter swing from said intermediate start position to the opposite extreme one and back again.

Figure 2:
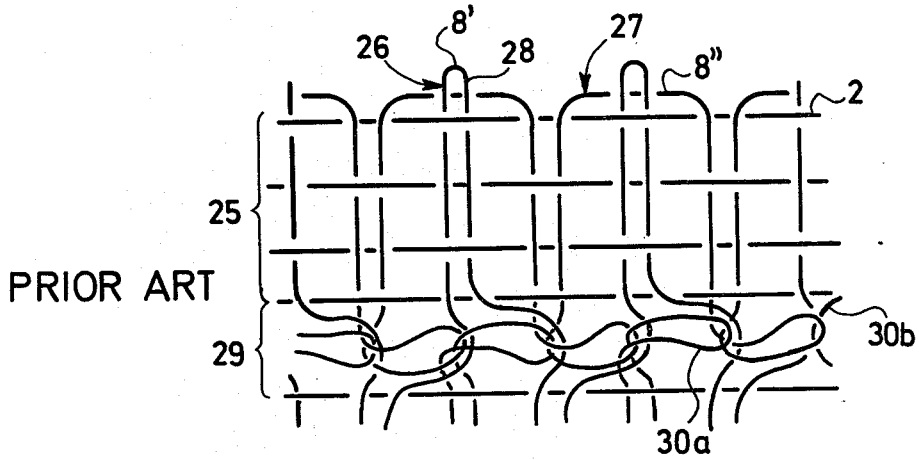

FIG. 2, labelled "Prior Art;" shows a selvage portion of a knit-woven fabric produced in accordance with the Czechoslovak Inventor's Certificate No. 162,120. The fabric comprises a longitudinal marginal strip 25 produced from weft loops 26 of weft thread 8' and from marginal loops 27 of the marginal weft thread 8''. End bights 28 of the weft loops 26 are not interlaced to wale but lie loose on the marginal loops 27 of the marginal weft thread 8''. The wale of stitches 29 situated always between adjacent longitudinal strips 25 is produced in this case alternately from closed reverse stitches 30*a*, 30*b* of the weft loops.

Figure 9:
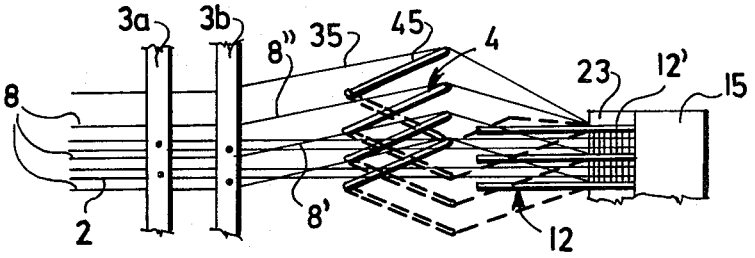
Figure 10:
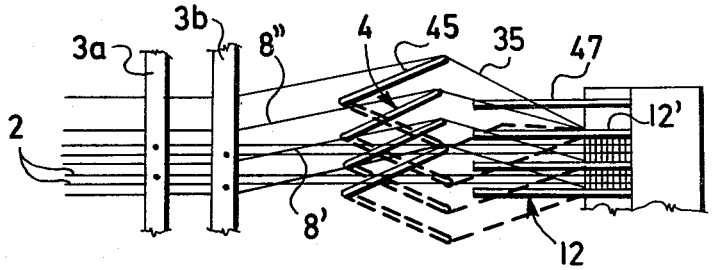
Figure 11:
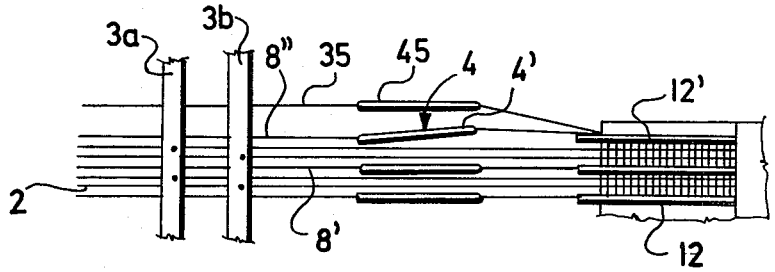

FIGS. 9 to 11 inclusive show three preferred embodiments of the mechanisms for producing respective knit-woven fabric selvage structure according to the invention.

In accordance with a first one of these embodiments (FIG. 9) an auxiliary lapping guide 45 is provided at either side of the lapping guide array, said lapping guide 45 serving for laying the lock thread 35, unwound from a not shown supply package, into the respective marginal knitting needle 12'.

The shape and operation of said auxiliary lapping guide 45 correspond to those of the lapping guides 4. Practically, the number of lapping guides 4 is thus increased by two additional ones only.

According to a second of preferred embodiments (FIG. 10), a hook 47 situated at either side of the knitting needle system, is associated to each of the auxiliary lapping guides 45. Such hook 47 is operable simultaneously with the knitting needles 12 and may be embodied, for example, as a latchless knitting needle.

Figure 8:
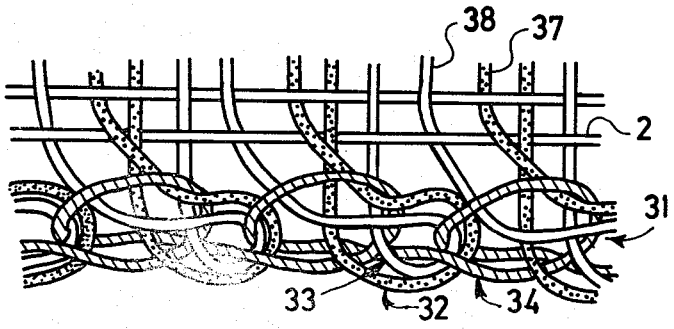

In accordance with a third preferred embodiment of the apparatus for producing selvage structures (FIG. 11), there are provided auxiliary lapping guides 45 substantially as shown in FIG. 8. However, the intermediate start position of the marginal lapping guide 4' is oriented relative to the intermediate start position of the auxiliary lapping guide 45 in such a manner that their geometrical projections onto a not shown horizontal plane are concurrent. Such an operating position of the marginal lapping guide 4' is provided for, e.g., by laterally bending the arm 6 of the lapping guide 4.

Figure 3:
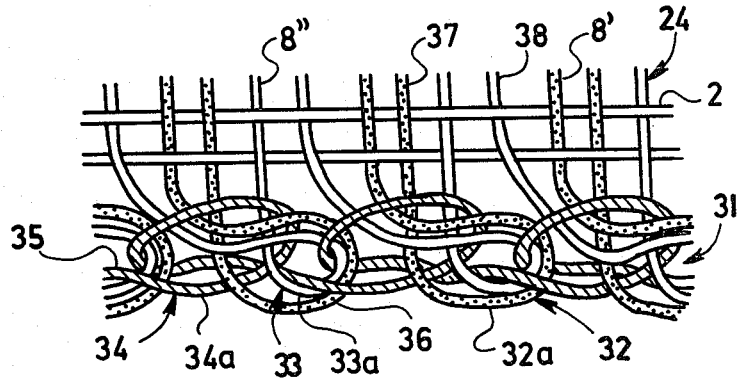

By means of the embodiment of the apparatus shown in FIG. 9 it is possible to produce the marginal structure shown in FIGS. 3 and 8, respectively.

FIGS. 12 to 19 inclusive show the process of producing the marginal structure as shown in FIGS. 3 and 8. For the sake of clarity, the knitting needles 12 are tilted down through a right angle into the horizontal plane. The warp threads 2 in the upper shed plane are indicated by short heavy lines 46.

Figure 12:
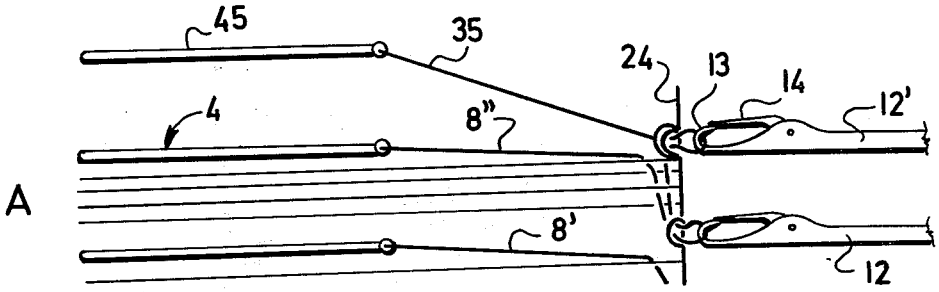

The individual positions of the lapping guides and the corresponding positions of the knitting needles are designated as follows:

A — lapping guides in the intermediate start position;

B — lapping guides in an extreme lapping position (moved outwards);

C — lapping guides in the opposite lapping position (moved inwards);

AB — lapping guides between the positions A and B (moving from A to B);

BA — lapping guides between the positions A and B (moving from B to A);

AC — lapping guides between the positions A and C (moving from A to C);

CA — lapping guides between the positions A and C (moving from C to A);

FIG. 12: The lapping guides 4, 45 are in the position A. The knitting needles 12 are in their first positions with old stitches in the closed hooks 13, the not shown reed in the beat-up position, warp threads 2 in the shed exchange phase.

Figure 13:
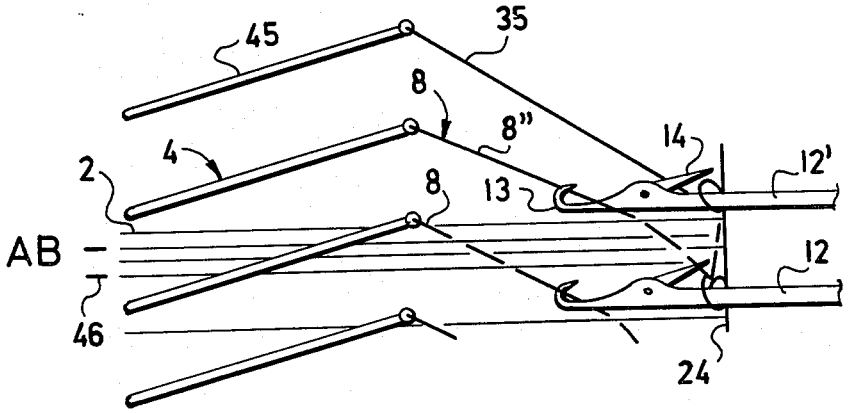

FIG. 13: The lapping guides 4, 45 are in the position AB. In the opening shed position of the warp threads 2, the lapping guides 4, 45 move to the extreme lapping position B while the knitting needles 12 enter the shed under the weft threads 8. The last but one needle 12 enters the shed under the weft thread 8' and the marginal knitting needle 12' under the marginal weft thread 8".

Figure 14:
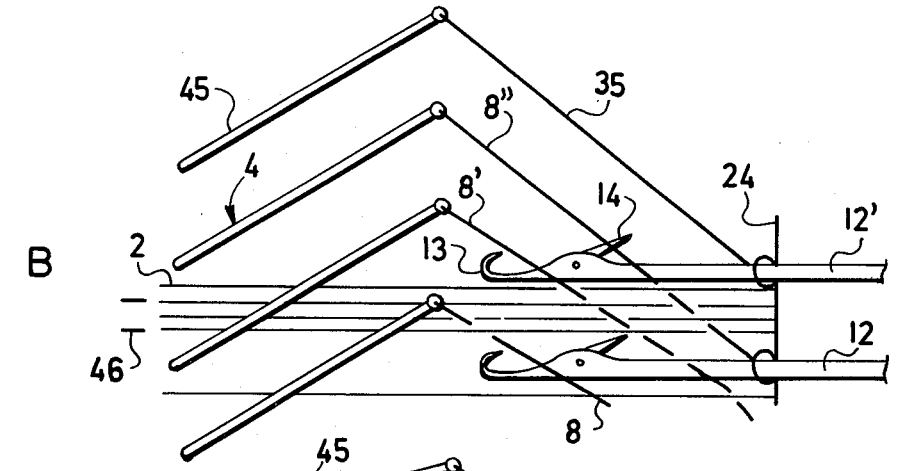

FIG. 14: The lapping guides 4, 45 are in the position B. The hooks 13 of the knitting needles 12 rise and take up the weft threads 8' while the knitting needle 12' takes up the marginal weft thread 8". The weft thread 8' is laid into the hook 13 of the marginal knitting machine 12' and the marginal weft thread 8" is laid onto the latch 14 of said needle 12'. The lock thread 35 is in inoperative or not knitting position.

Figure 15:
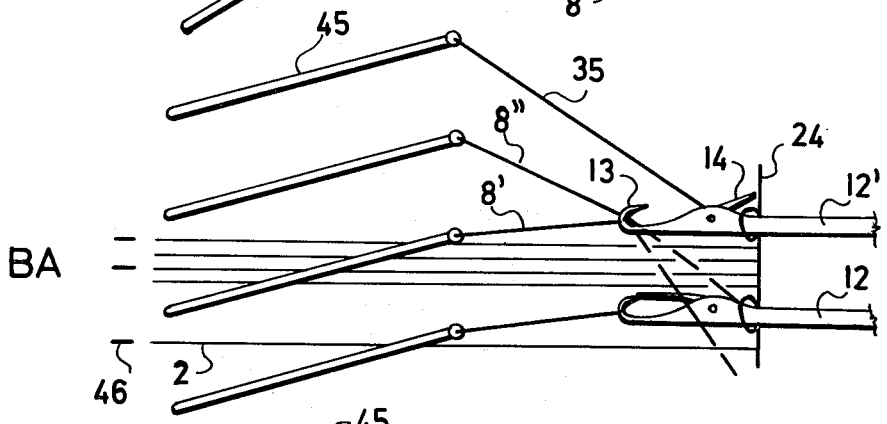

FIG. 15: The lapping guides 4, 45 are in the position BA. The shed is in the closing phase, lapping guides 4, 45 return to their intermediate start positions and the knitting needles 12 to their foremost positions while their hooks 13 with wefts in are being closed by weft threads laid onto the stems of the knitting needles 12, the latch 14 of the marginal knitting needle 12' only being closed by the old stitch.

Figure 16:
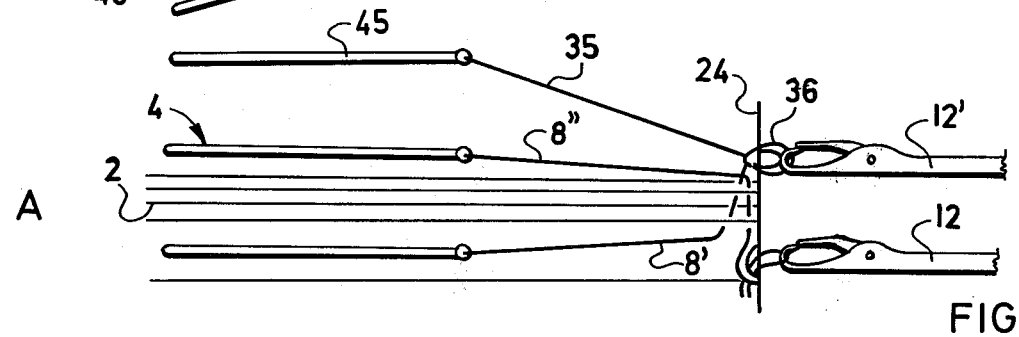

FIG. 16: The lapping guides 4, 45 are in the position A and the knitting needles 12 are in their front position. In the closed hook 13 of the marginal knitting needle 12' there is laid the double stitch 36 produced by the stitch 32*a* from the weft thread 8' and by the stitch 33*a* from the marginal weft thread 8" which double stitch 36 was drawn through old stitch 34*a* from the lock thread 35. Simultaneously a shed exchange occurs and the reed 11 is in the beat-up position. Thus the first work cycle is over.

Figure 17:
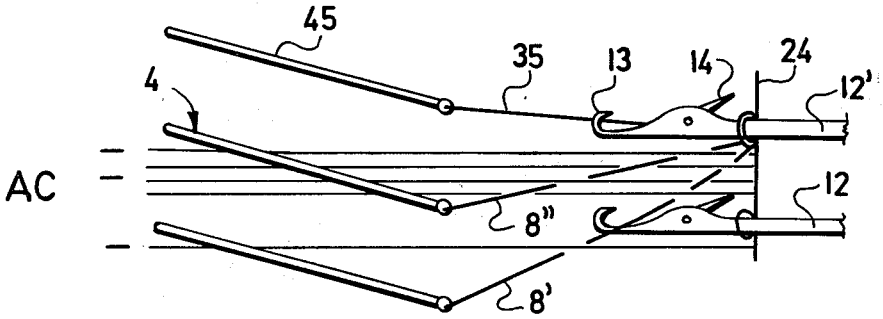

FIG. 17: The lapping guides 4, 45 are in the position AC. As the shed opens, the lapping guides 4, 45 move into their extreme lapping position while the knitting needles 12, 12' enter the shed under the weft threads 8', under the marginal weft thread 8" and under the lock thread 35.

Figure 18:
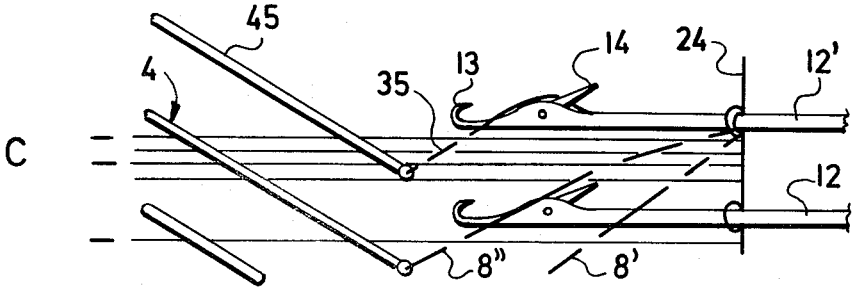

FIG. 18: The lapping guides 4, 45 are in the position C. The shed is in fully open phase. The marginal weft thread 8" is laid into the hook 13 of the knitting needle 12 and onto its stem there is laid the weft thread 8' which is laid into the hook of a not shown knitting needle adjacent the knitting needle 12 shown in FIG. 18. The lock thread 35 is laid into the hook 13, or onto the latch 14 of the marginal knitting needle 12'.

Figure 19:
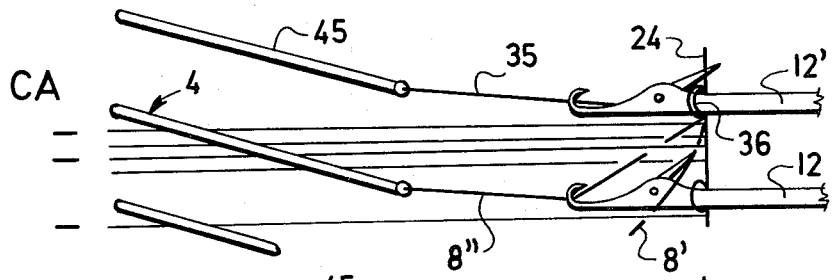

FIG. 19: The lapping guides 4, 45 are in the position CA. During the movement of the knitting needles 12 to the foremost position, a new stitch is being built on the marginal knitting needle 12' from the lock thread 35 by drawing it through a double stitch while on the needle 12 there is formed also a new stitch from the marginal weft thread 8" by drawing it through the old stitch. In this way the second work cycle is ended in the position of the knitting mechanism members as shown in FIG. 12.

Figure 4:
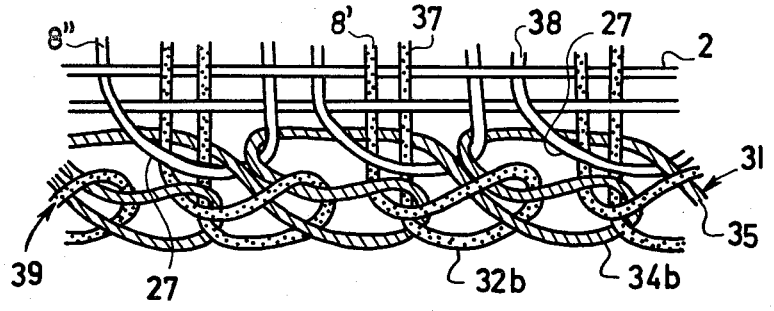

FIGS. 20–27 show schematically the process of producing the selvage structure according to FIG. 4 by means of the apparatus illustrated in FIG. 10, which apparatus is characterized in that to each of the auxiliary lapping guide 45 there is associated the hook 47 arranged in either side of the knitting needle system.

Figure 20:
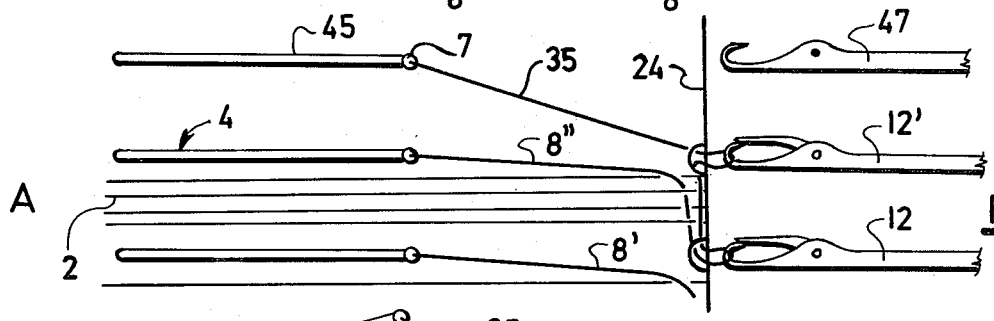

FIG. 20: The lapping guides 4, 45 are in the position A, the knitting needles 12 in the foremost position and the weft threads are beaten into the fell of the fabric 24.

Figure 21:
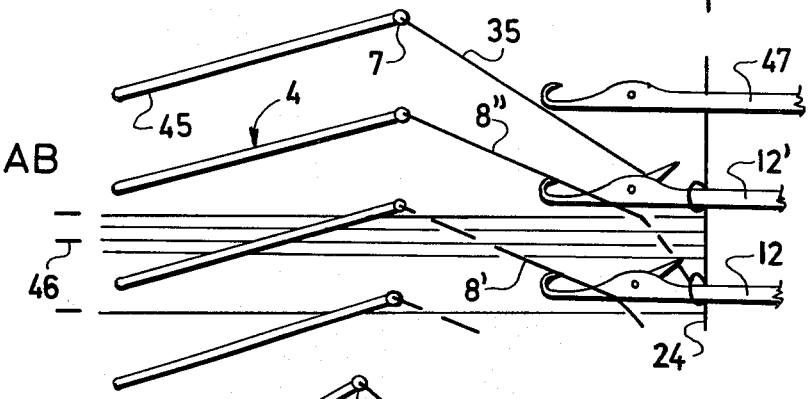

FIG. 21: The lapping guides 4, 45 are in the position AB, the knitting needle 12 enters the shed under the weft thread 8', the marginal knitting needle 12' under the marginal thread 8" and the hook 47 under the lock thread 35.

Figure 22:
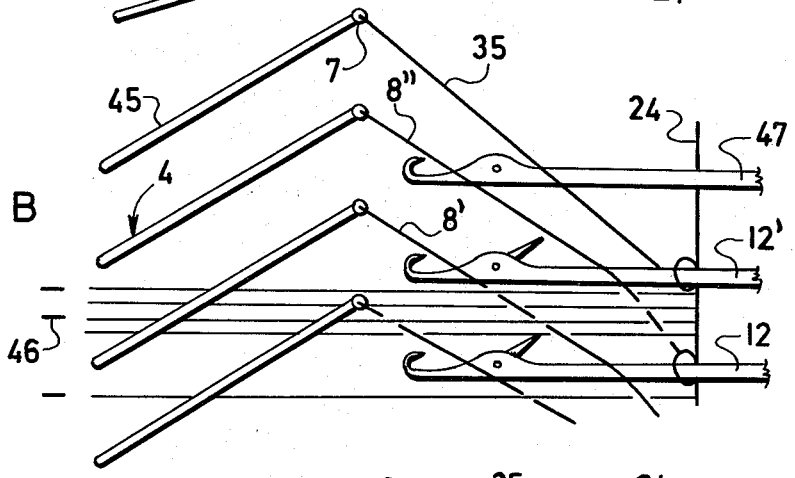

FIG. 22: The lapping guides 4, 45 are in the position C. The hooks 13 of the knitting needles 12 and the hook 47 rise and take up the weft threads 8. The weft thread 8' is laid into the hook 13 of the marginal knitting needle 12', and on its stem there is laid the marginal weft thread 8" and the lock thread 35.

Figure 23:
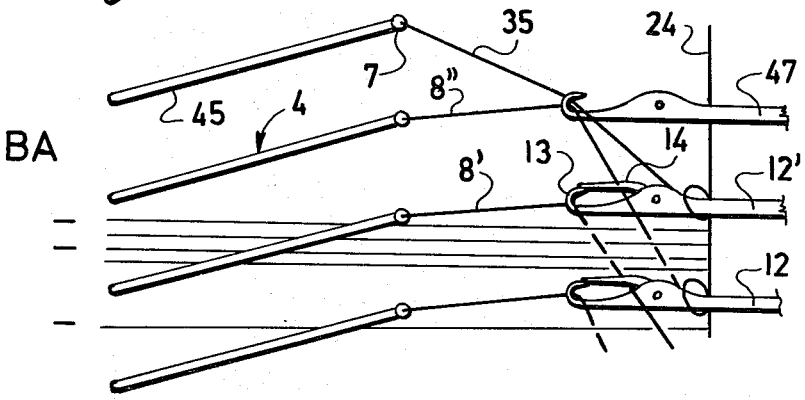

FIG. 23: The lapping guides 4, 45 are in the position CA. The marginal knitting needle 12' pulls the weft thread 8', the latch 14 of the marginal knitting needle 12' closes the hook 13 by the marginal weft thread 8", and the hook 47 tensions the marginal weft thread 8" and the lock thread 35.

Figure 24:
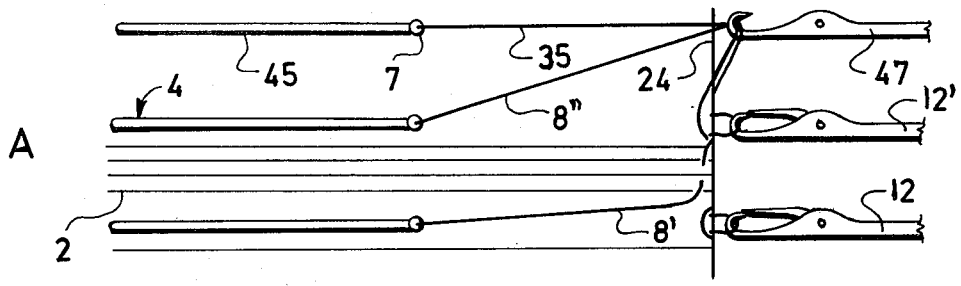

FIG. 24: The lapping guides 4, 45 are in the position A. The marginal knitting needle 12' has drawn a loop of the weft thread 8' through the old stitch whereby a new stitch is built while the marginal weft thread 8" and the lock thread 35 are held in the hook 47; the not shown reed beats up the weft threads into the fabric and a shed exchange occurs whereby the first work cycle is over.

Figure 25:
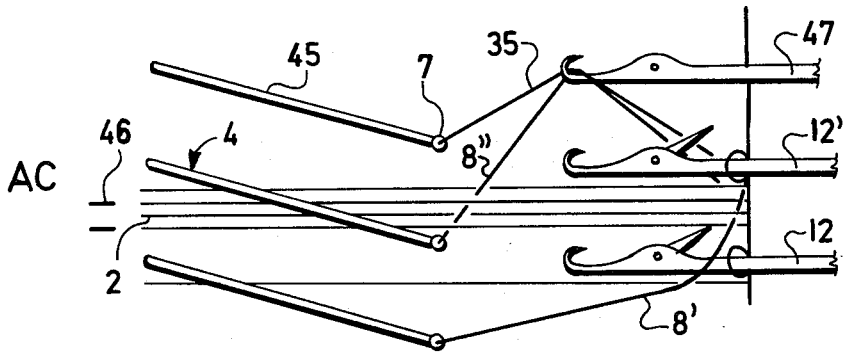

FIG. 25: The lapping guides 4, 45 are in the position AC.

Figure 26:
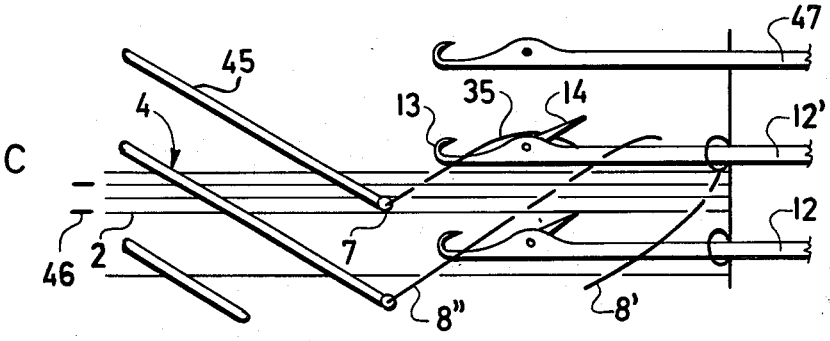

FIG. 26: The lapping guides 4, 45 are in the position C. About at a half of the path of knitting needles 12 and the hook 47, i.e., between the foremost and the rear positions thereof, the lock thread 35 and the marginal weft thread 8" slip out of the hook 47 and are engaged by the marginal knitting needle 12'. In such situation depicted in FIG. 26, the marginal weft thread 8" encircling the stem of the marginal knitting needle 12' is laid into the lock 13 of the last but one knitting needle 12 while the lock thread 35 is laid over the latch 14 into the hook 13 of the marginal knitting needle 12'.

Figure 27:
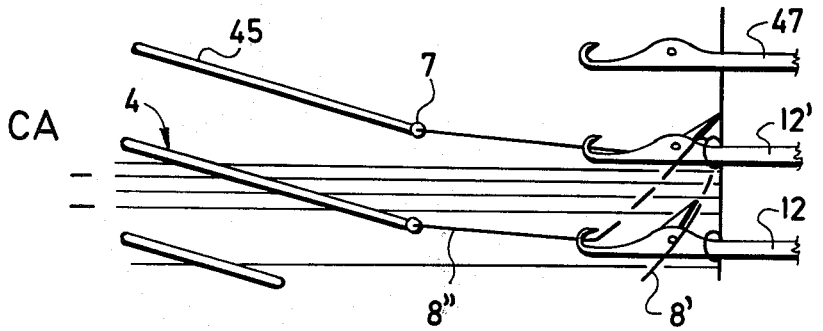

FIG. 27: The lapping guides 4, 45 are in the position CA. In the next phase of movement of lapping guides 4, 45 to the position A, the marginal knitting needle 12' draws a loop of lock thread 35 through the old stitch, and the last but one knitting needle 12 draws a loop of the marginal weft thread 8" through the old stitch. Thereafter the knitting mechanism will assume the position according to FIG. 20.

A condition of producing the marginal wale 31 shown in FIG. 4 resides in that during the inward laying, the marginal weft thread 8" must be reliably laid onto the stem of the marginal knitting needle 12', and the lock thread 35 into its hook 13, or onto its latch 14 (FIG. 26); this can be achieved, for example, by a suitable selection of length of the latch 14.

Figure 5:
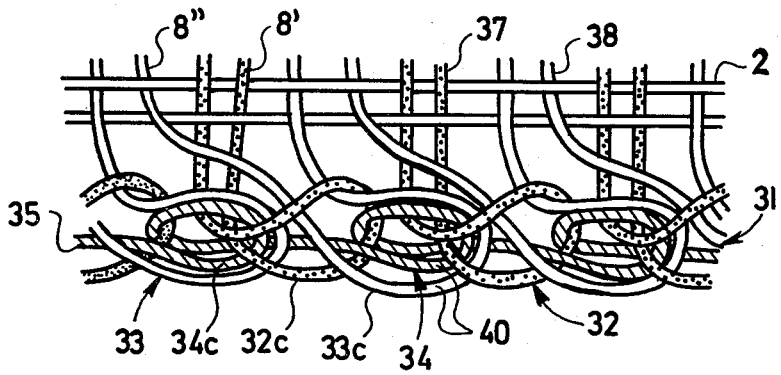
Figure 28:
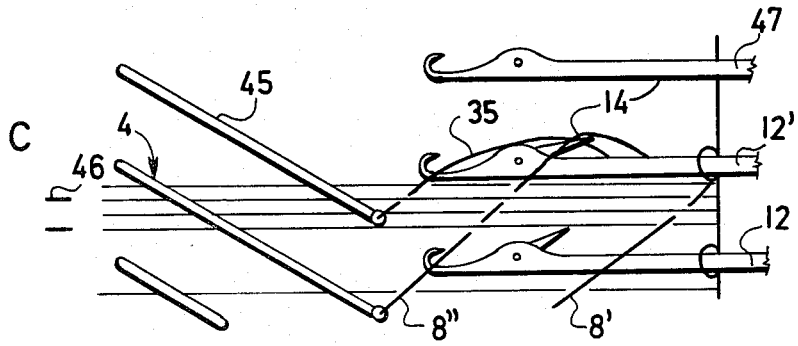

FIGS. 20–25 and 28–29 show schematicaly the process of producing the selvage structure according to FIG. 5 by means of the apparatus arrangement illustrated in FIG. 10, by using a latch 14' as long as possible in view of the correct function of knitting needle. The process of producing the selvage structure in accordance with FIG. 5 is the same as that for producing the structure shown in FIG. 4, up to the position AC shown in FIG. 25. The next steps for the position C are shown in FIG. 28.

FIG. 28: The lapping guides 4, 45 are in the position C. The marginal weft thread 8" and the lock thread 35, after having slipped out of the hook 47, encircle the marginal knitting needle 12', in such a manner that the lock thread 35 is laid into the hook of the marginal knitting needle 12', the marginal weft thread 8" onto the latch 14' of the marginal knitting needle 12' and into the hook 13 of the adjacent knitting needle 12.

Figure 29:
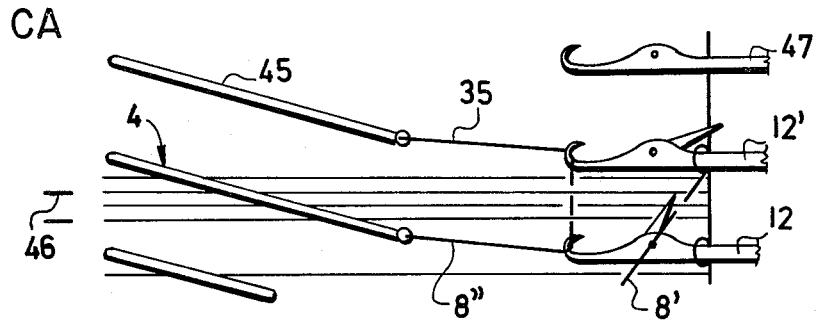

FIG. 29: The lapping guides 4, 45 are in the position CA. The knitting needles 12 pull the laid threads. In the hook 13 of the marginal knitting needle 12' there is received the lock thread 35 and the marginal weft thread 8" which latter, however, is simultaneously in the hook 13 of the last but one knitting needle 12. In this way there are built on the marginal knitting needle 12' double stitches 40 in the marginal wale 31 (FIG. 5) which double stitches bind with stitches 32*c* from the weft threads 8'.

A condition of producing the marginal wale 31 shown in FIG. 5 consists in that during the inward laying, the marginal weft thread 8" must be reliably laid onto the latch 14' of the marginal knitting needle 12' (FIG. 28). This can be achieved, for example, by a suitable selection on length of the latch 14' of said needle.

Figure 6:
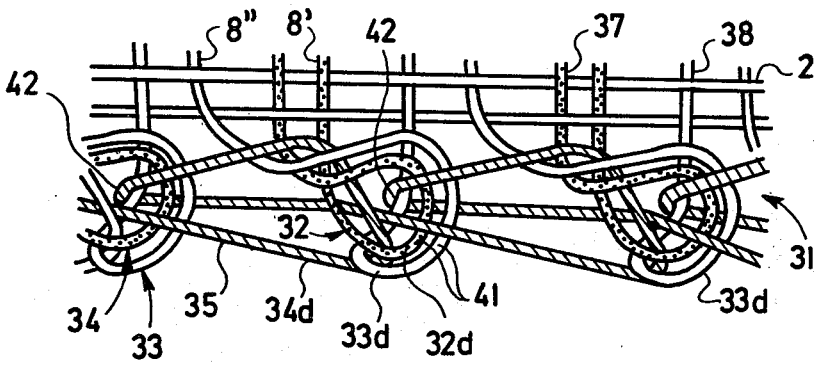

FIGS. 20, 21, 30–32 and 25–27 show schematically the process of producing the selvage structure according to FIG. 6 by means of the apparatus arrangement illustrated in FIG. 10, by using suitably long latch 14' of the marginal knitting needle 12'. Another condition is to apply such a tension of the marginal weft thread 8" that a length of said thread between the stitch on the last but one knitting needle 12 and the marginal lapping guide 4 will be as straight as possible so that said length will pass over the latch 14' of the marginal knitting needle 12'. The foregoing is apparent from FIG. 30, which shows the lapping guides 4, 45 in the position B.

Figure 30:
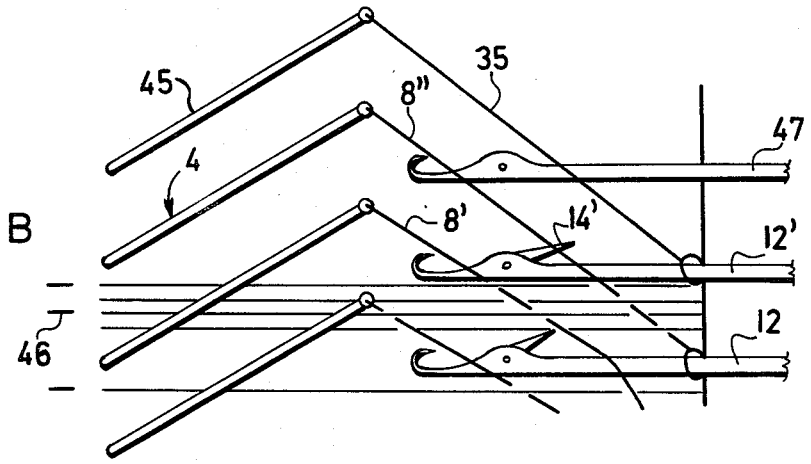

When comparing FIG. 30 with FIG. 22, a difference can be found in that in FIG. 30 the marginal weft thread 8" passes over the prolonged latch 14' of the marginal knitting needle 12'.

Figure 31:
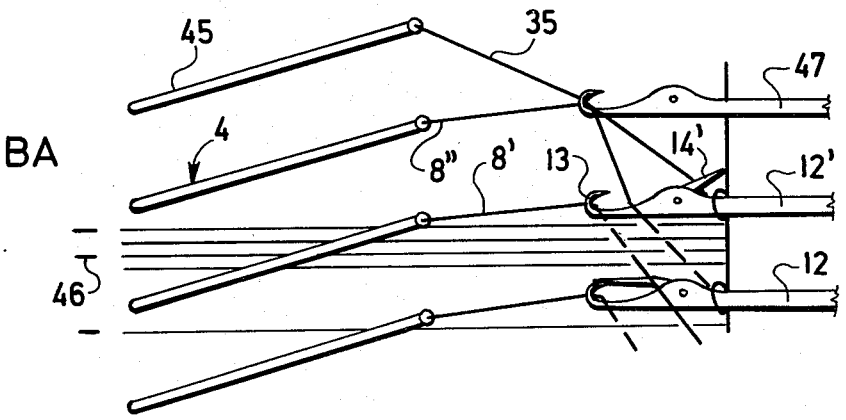

FIG. 31: The lapping guides 4, 45 are in the position BA. The knitting needles 12 and the hook 47 pull the threads laid in. In the hook 47 there are entrapped the lock thread 35 and the marginal weft thread 8" which latter simultaneously lies in the hook 13 of the marginal knitting needle 12' together with the weft thread 8'.

Figure 32:
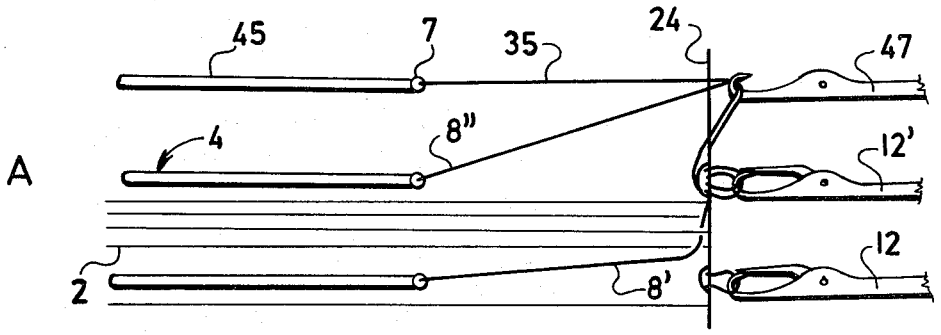

FIG. 32: The lapping guides 4, 45 are in the position A. The marginal knitting needle 12' has drawn, through the old stitch 34*d* from the lock thread 35, the stitch 32 from the weft thread 8' and the stitch 33 from the marginal weft thread 8" which stitches, in the next work cycle, become double stitch 41 (FIG. 6). The individual phases of said next cycle are shown in FIGS. 25–27, except that the double stitch 41 (not there shown) is drawn over the stem of the marginal knitting needle 12'.

The stitches 34*d* built from the lock thread 35 simultaneously form the tuck 42 of the connecting loops 38 of the stitches 33*d* from the marginal weft thread 8" (FIG. 6).

The tuck 42 will arise because the marginal weft thread 8" is laid onto the stem of the marginal knitting needle 12', as results from FIG. 26, and that in the following motion phases, said thread 8" is underlapped by a loop of the lock thread 35.

Figure 7:
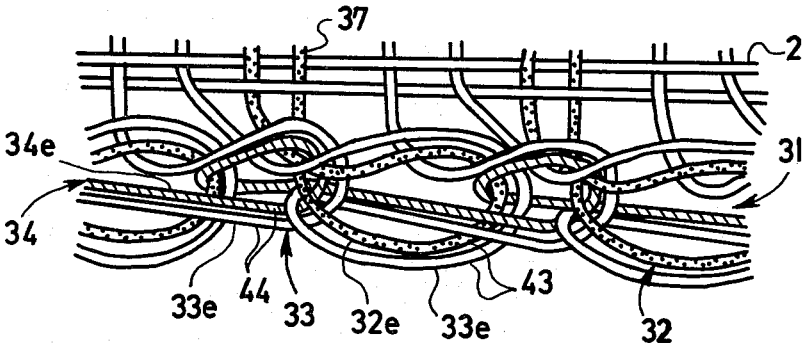

FIGS. 20, 21, 30–32, 25, 28 and 29 schematically show the process of producing the selvage structure according to FIG. 7 by means of the apparatus arrangement illustrated in FIG. 10.

It is a condition of producing the afore-described selvage structure that during the movement of the lapping guides 4, 45 from the position A to the position B, both the weft thread 8' and the marginal weft thread 8" (FIGS. 30, 31) must be laid into the hook 13 or onto the latch 14' of the marginal knitting needle 12', and that during the laying motion from the position A to the position C both the marginal weft thread 8" and the lock thread 35 (FIGS. 28, 29) must be laid into the same hook 13. In this way there arise double stitches 43 produced by stitches 32*e* from the weft thread 8' and by stitches 33*e* from the marginal weft thread 8", which double stitches 43 bind with double stitches 44 built by stitches 33*e* from the marginal weft thread 8" and by stitches 34*e* from the lock thread 35.

The afore-mentioned conditions can be achieved by using a marginal knitting needle 12' having a latch 14' as long as possible.

By means of the arrangement shown in FIG. 11, which uses the bent marginal lapping guide 4', it is possible to build-in a manner similar to the apparatus arrangement according to FIG. 10 — the selvage structures illustrated in FIGS. 4, 5, 6 and 7. The encircling of the marginal knitting needle 12' (FIG. 11), as the lapping guides 4, 45 move from the position A to the position C, is ensured since the marginal knitting needle 12', during its movement into the shed, passes the marginal weft thread 8" at the left side thereof, that is, at the right-hand fabric selvage.

FIGS. 3 to 8 show selvage structures at the right-hand side of the fabric. The left-hand selvage structures (not shown) are mirror images of the right-hand ones. The process of building the left-hand selvage structures corresponds to that of building the right-hand ones. Also FIGS. 9–11 show a knitting mechanism for building right-hand selvage structures. The function of the knitting mechanism for building left-hand selvage structures is the same as that of the knitting mechanism for building the right-hand selvage structures.

The selvage structures as illustrated in FIGS. 3 to 7 are feasible in manufacturing knit-woven fabrics disclosed in the Czechoslovak Inventor's Certificates Nos. 162,119 and 162,120 under the conditions set forth with each particular selvage structure.

In the event the constant lapping conditions, especially as regards the marginal weft thread 8", are not kept — which is possible if using weaves other than a plain weave — a wale may arise which is built by parts of or individual stitches which are typical for the particular kinds of weave. This, however, is not a drawback since in every case a firm run-proof selvage of knit-woven fabric is obtained.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An arrangement for making a selvage structure of a knit-woven fabric in an apparatus for producing a knit-woven fabric, said fabric being produced in a warp-knit structure from weft thread loops and comprising spaced apart stitch wales with warp thread groups disposed therebetween, said warp threads being interlaced with stitch connecting loops to form a weave while the fabric selvage consists of a weft thread and a marginal weft thread, the selvage structure including a marginal wale built by mutually binding stitches from a weft thread, stitches from a marginal weft thread and stitches from a lock thread, said arrangement including a knitting mechanism for building a warp-knit structure from loops of weft thread unwound from a stationary supply, means for beating up stitch connecting loops into the fabric fell, said knitting mechanism comprising, on the one hand, a system of lapping guides the lapping arms of which are reciprocatorily swingable in open shed from an intermediate start position to one of extreme lapping positions and back again, the lapping guides protruding permanently between warp threads of at least one of the two shed planes, and, on the other hand, a system of knitting needles with closable hooks, of which number corresponds to that of lapping guides, the knitting needle system being arranged across the fabric and mounted for reciprocation from a foremost start position in front of the beat-up plane of the fabric to an operating position in open shed and back again, in order to engage the weft threads being laid, the improvement which comprises an auxiliary lapping guide arranged at either side of the system of lapping guides for laying the lock thread unwound from a supply package into the marginal knitting needle, the operation of said auxiliary lapping guide being the same as that of the lapping guides.

2. The arrangement as claimed in claim 1, wherein with each of the auxiliary lapping guides there is associated a hook disposed at either side of the system of knitting needles and movable in synchronism with the knitting needles for temporarily engaging the lock thread laid by the auxiliary lapping guides and for engaging the marginal weft thread laid by the marginal lapping guide.

3. The arrangement as claimed in claim 2, wherein the intermediate starting position of the marginal lapping guide is orientated relative to the intermediate starting position of the auxiliary lapping guide in such a manner that the geometrical projections of the two guides onto a horizontal plane are concurrent.

* * * * *